US008141325B2

(12) United States Patent
Cheng et al.

(10) Patent No.: US 8,141,325 B2
(45) Date of Patent: Mar. 27, 2012

(54) COMPOSITE PANEL ASSEMBLY

(75) Inventors: Hsien-Te Cheng, Kuei-Jen Hsiang (TW); Hsien-Sung Cheng, Kuei-Jen Hsiang (TW)

(73) Assignee: Xxentria Technology Materials Co., Ltd., Tainan Hsien (TW)

( * ) Notice: Subject to any disclaimer, the term of this patent is extended or adjusted under 35 U.S.C. 154(b) by 279 days.

(21) Appl. No.: 12/271,179

(22) Filed: Nov. 14, 2008

(65) Prior Publication Data

US 2010/0011695 A1 Jan. 21, 2010

(30) Foreign Application Priority Data

Jul. 16, 2008 (TW) ..... 97126947 A

(51) Int. Cl.
*E04C 2/34* (2006.01)

(52) U.S. Cl. ..... 52/792.11; 52/591.1; 52/582.1

(58) Field of Classification Search ..... 52/592.1, 52/582.1, 579, 783.1, 792.11, 588.1, 792.1, 52/581, 586.1, 591.1, 309.11, 309.9, 589.1; 428/33, 52, 53, 57, 58
See application file for complete search history.

(56) References Cited

U.S. PATENT DOCUMENTS

| | | | | |
|---|---|---|---|---|
| 2,644,552 | A * | 7/1953 | MacDonald | 52/580 |
| 3,397,496 | A * | 8/1968 | Sohns | 52/580 |
| 4,186,539 | A * | 2/1980 | Harmon et al. | 52/580 |
| 4,316,351 | A * | 2/1982 | Ting | 52/309.9 |
| 4,936,078 | A * | 6/1990 | Porter | 52/592.1 |
| 5,204,149 | A * | 4/1993 | Phenicie et al. | 428/57 |
| 5,613,338 | A * | 3/1997 | Esposito | 52/588.1 |
| 6,834,468 | B1 * | 12/2004 | Kroie | 52/590.2 |
| 2008/0086965 | A1 * | 4/2008 | Metz et al. | 52/309.9 |

* cited by examiner

*Primary Examiner* — Branon Painter
(74) *Attorney, Agent, or Firm* — Occhiuti Rohlicek & Tsao LLP

(57) ABSTRACT

A composite panel assembly includes: a first composite panel having first and second contact surfaces, and including upper and lower protective layers, and a first core; and a second composite panel having third and fourth contact surfaces, and including upper and lower protective layers, and a second core. The first contact surface of the first composite panel is disposed above and abuts against the third contact surface of the second composite panel, and the second contact surface of the first composite panel is disposed below and abuts against the fourth contact surface of the second composite panel.

5 Claims, 5 Drawing Sheets

COMPOSITE PANEL ASSEMBLY

CROSS-REFERENCE TO RELATED APPLICATION

This application claims priority of Taiwanese application no. 097126947, filed on Jul. 16, 2008.

BACKGROUND OF THE INVENTION

1. Field of the Invention

This invention relates to a composite panel assembly, more particularly to a composite panel assembly including first and second composite panels which are prevented from undergoing relative movement with respect to each other.

2. Description of the Related Art

FIG. 1 shows a conventional composite panel assembly including: a first composite panel 1 that has first and second contact surfaces 121, 122, and that includes an upper layer 12, a lower layer 13, and a first core 11 sandwiched between the upper and lower layers 12, 13; and a second composite panel 10 that has third and fourth contact surfaces 123, 124, and that includes an upper layer 14, a lower layer 15, and a second core 16 sandwiched between the upper and lower layers 14, 15. The upper and lower layers 12, 13 of the first composite panel 1 define the first and second surfaces 121, 122, respectively. The upper and lower layers 14, 15 of the second composite panel 10 define the third and fourth surfaces 123, 124, respectively.

In order to assemble the first and second composite panels 1, 10 to each other, an adhesive is applied to the first and second contact surfaces 121, 122 of the first composite panel 1 and/or the third and fourth contact surfaces 123, 124 of the second composite panel 10, after which the first and second contact surfaces 121, 122 of the first composite panel 1 are positioned to rest respectively against the third and fourth contact surfaces 123, 124 of the second composite panel 10. Since the first and second contact surfaces 121, 122 of the first composite panel 1 are disposed above and are simply rested against the third and fourth contact surfaces 123, 124 of the second composite panel 10, the first and second composite panels 1, 10 are likely to move with respect to each other in a direction perpendicular to the first and second composite panels 1, 10 if the first and second composite panels 1, 10 are moved or otherwise handled before the adhesive is fully dried. Therefore, the first and second composite panels 1, 10 must be left sitting for some time at the location where they were assembled until the adhesive is dried. Due to these reasons, assembly of the first and second composite panels 1, 10 is time-consuming, and, when large-scale manufacturing is involved, requires the use of a large factory space where a plurality of the first and second composite panels 1, 10 must be placed while the adhesive dries

SUMMARY OF THE INVENTION

Therefore, an object of the present invention is to provide a composite panel assembly that can overcome the aforesaid drawbacks associated with the prior art.

According to the present invention, a composite panel assembly comprises: a first composite panel having first and second contact surfaces, and including upper and lower protective layers, and a first core sandwiched between the upper and lower protective layers of the first composite panel, the upper protective layer of the first composite panel defining the first contact surface, one of the lower protective layer and the first core of the first composite panel defining the second contact surface; and a second composite panel having third and fourth contact surfaces, and including upper and lower protective layers, and a second core sandwiched between the upper and lower protective layers of the second composite panel, the upper protective layer of the second composite panel defining the third contact surface, one of the upper protective layer and the lower protective layer of the second composite panel defining the fourth contact surface. The first contact surface of the first composite panel is disposed above and abuts against the third contact surface of the second composite panel, and the second contact surface of the first composite panel is disposed below and abuts against the fourth contact surface of the second composite panel.

BRIEF DESCRIPTION OF THE DRAWINGS

Other features and advantages of the present invention will become apparent in the following detailed description of the preferred embodiments of this invention, with reference to the accompanying drawings, in which.

DETAILED DESCRIPTION OF THE PREFERRED EMBODIMENTS

Figure 1:
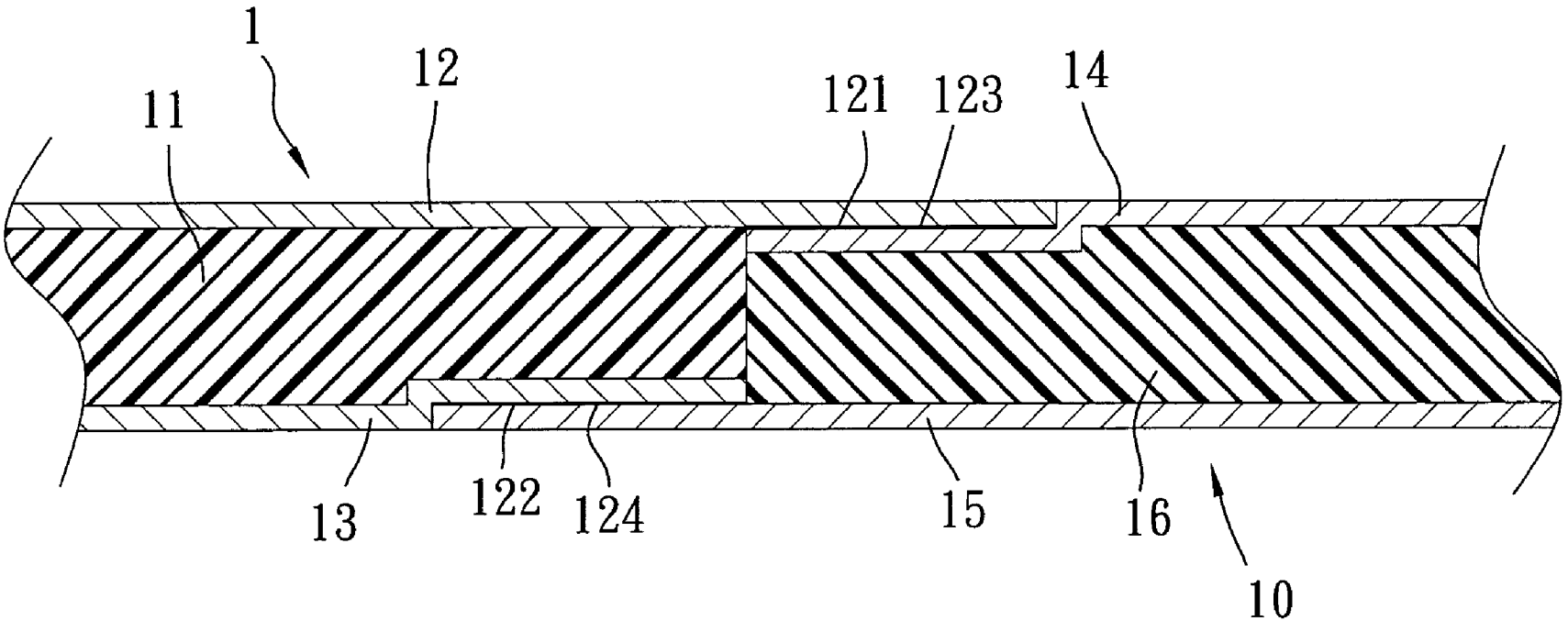
FIG. 1 PRIOR ART
FIG. 1 is a fragmentary assembled sectional view of a conventional composite panel assembly.

Before the present invention is described in greater detail with reference to the accompanying preferred embodiments, it should be noted herein that like elements are denoted by the same reference numerals throughout the disclosure.

Figure 2:
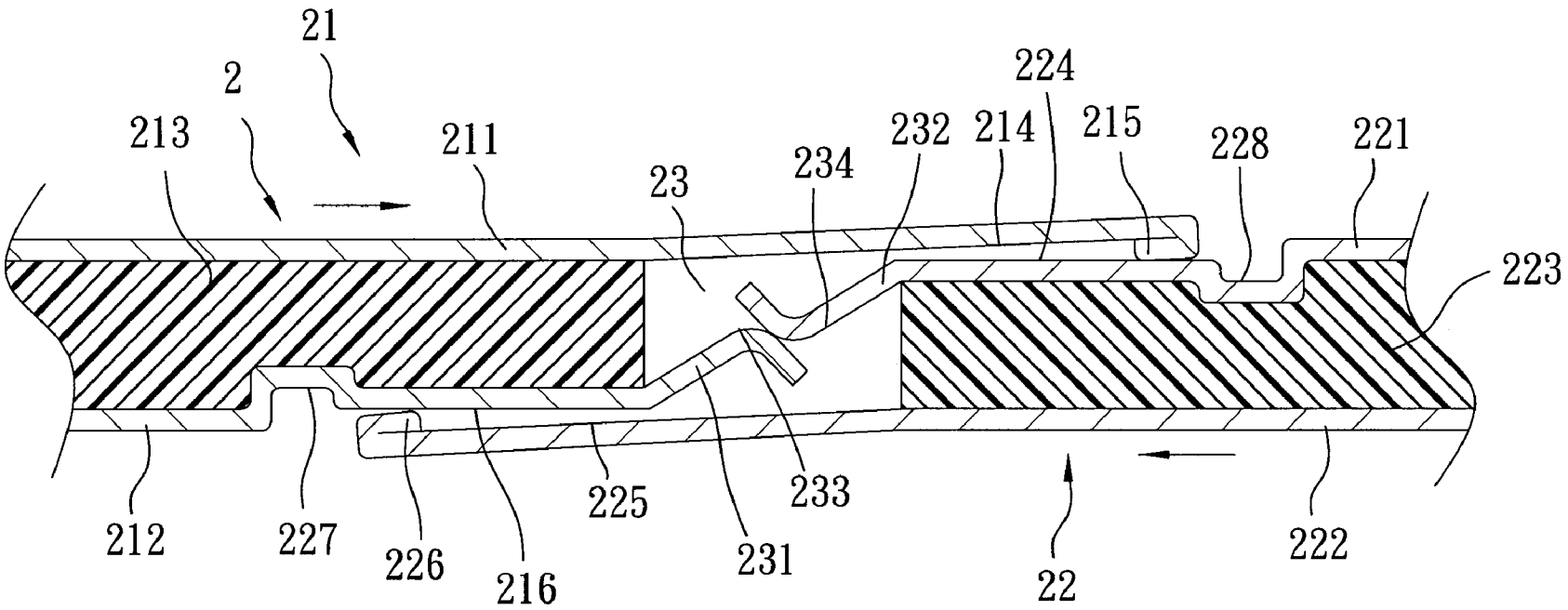
FIG. 2 is a fragmentary partly assembled sectional view of the first preferred embodiment of a composite panel assembly according to this invention.
Figure 3:
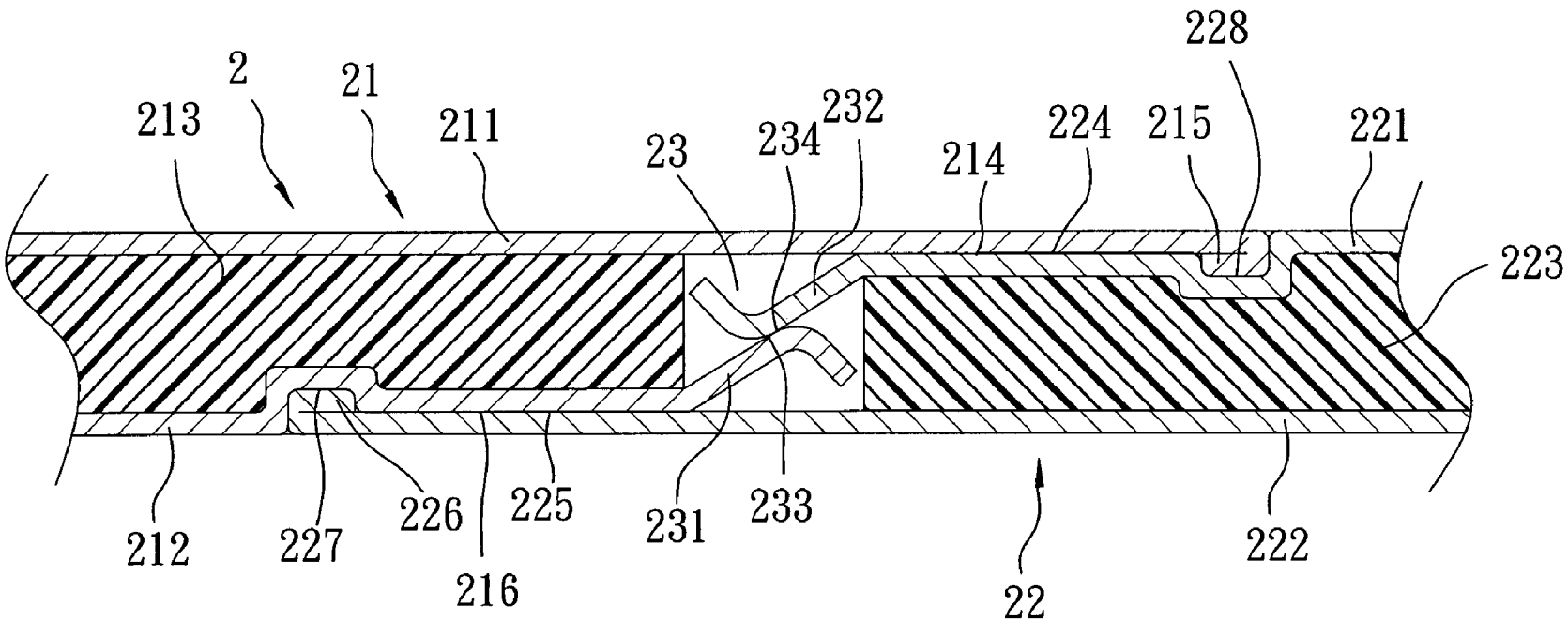
FIG. 3 is a fragmentary assembled sectional view of the first preferred embodiment.

FIGS. 2 and 3 illustrate the first preferred embodiment of a composite panel assembly 2 according to this invention.

The composite panel assembly 2 includes: a first composite panel 21 having first and second contact surfaces 214, 233, and including upper and lower protective layers 211, 212, and a first core 213 sandwiched between the upper and lower protective layers 211, 212 of the first composite panel 21, the upper protective layer 211 of the first composite panel 21 defining the first contact surface 214, the lower protective layer 212 of the first composite panel 21 defining the second contact surface 233; and a second composite panel 22 having third and fourth contact surfaces 224, 234, and including upper and lower protective layers 221, 222, and a second core 223 sandwiched between the upper and lower protective layers 221, 222 of the second composite panel 22, the upper protective layer 221 of the second composite panel 22 defining both the third contact surface 224 and the fourth contact surface 234. The first contact surface 214 of the first composite panel 21 is disposed above and abuts against the third contact surface 224 of the second composite panel 22, and the second contact surface 233 of the first composite panel 21 is disposed below and abuts against the fourth contact surface 234 of the second composite panel 22, such that relative movement between the first and second composite panels 21, 22 in a direction perpendicular to the first and second composite panels 21, 22 can be prevented.

Preferably, the upper and lower protective layers 211, 212, 221, 222 of the first and second composite panels 21, 22 are made from metal.

In this embodiment, a space 23 is defined between the first and second cores 213, 223, and the second contact surface 233 of the first composite panel 21 abuts against the fourth contact surface 234 of the second composite panel 22 in the space 23.

In this embodiment, the lower protective layer 212 of the first composite panel 21 and the upper protective layer 221 of the second composite panel 22 respectively include resilient V-shaped bend segments 231, 232 that extend into the space 23 and that define respectively the second contact surface 233 and the fourth contact surface 234. The V-shaped bend segments 231, 232 of the first and second composite panels 21, 22 are releasably press-fitted against each other in the space 23.

In this embodiment, the lower protective layer 212 of the first composite panel 21 defines a fifth contact surface 216, and the lower protective layer 222 of the second composite panel 22 defines a sixth contact surface 225 which abuts against the fifth contact surface 216 of the first composite panel 21.

In this embodiment, each of the lower protective layer 212 of the first composite panel 21 and the upper protective layer 221 of the second composite panel 22 is formed with a recess 227, 228, and each of the upper protective layer 211 of the first composite panel 21 and the lower protective layer 222 of the second composite panel 22 includes an insert 215, 226. The insert 215 of the first composite panel 21 is fitted into the recess 228 in the second composite panel 22, and the insert 226 of the second composite panel 22 is fitted into the recess 227 in the first composite panel 21.

In this embodiment, the inserts 215, 226 are formed by folding respectively the upper protective layer 211 of the first composite panel 21 and the lower protective layer 222 of the second composite panel 22.

In order to assemble the first and second composite panels 21, 22 to each other, first, the bend segments 231, 232 of the first and second composite panels 21, 22 are placed in contact with each other, as shown in FIG. 2. In this state, the first and fifth contact surfaces 214, 216 of the first composite panel 21 are spaced apart from the third and sixth contact surfaces 224, 225 of the second composite panel 22, respectively. Subsequently, the first and second composite panels 21, 22 are pressed toward each other (see the arrows in FIG. 2), such that the bend segments 231, 232 of the first and second composite panels 21, 22 are snap-engaged with each other, and the inserts 215, 226 of the first and second composite panels 21, 22 are fitted into the recesses 228, 227 of the second and first composite panels 22, 21, respectively. As a result, with reference to FIG. 3, the first, second and fifth contact surfaces 214, 233, 216 of the first composite panel 21 abut respectively against the third, fourth, and sixth contact surfaces 224, 234, 225 of the second composite panel 22. Since the first contact surface 214 of the first composite panel 21 is disposed above the third contact surface 224 of the second composite panel 22, and the second contact surface 233 of the first composite panel 21 is disposed below the fourth contact surface 234 of the second composite panel 22, relative movement of the first and second composite panels 21, 22 in the direction perpendicular to the first and second composite panels 21, 22 can be prevented.

Preferably, an adhesive (not shown) is applied to any one or all of the inserts 215, 226 of the first and second composite panels 21, 22, the recesses 227, 228 of the first and second composite panels 21, 22, the first and fifth contact surfaces 214, 216 of the first composite panel 21, and the third and sixth contact surfaces 224, 225 of the second composite panel 22 before assembling the composite panel assembly 2.

Figure 4:
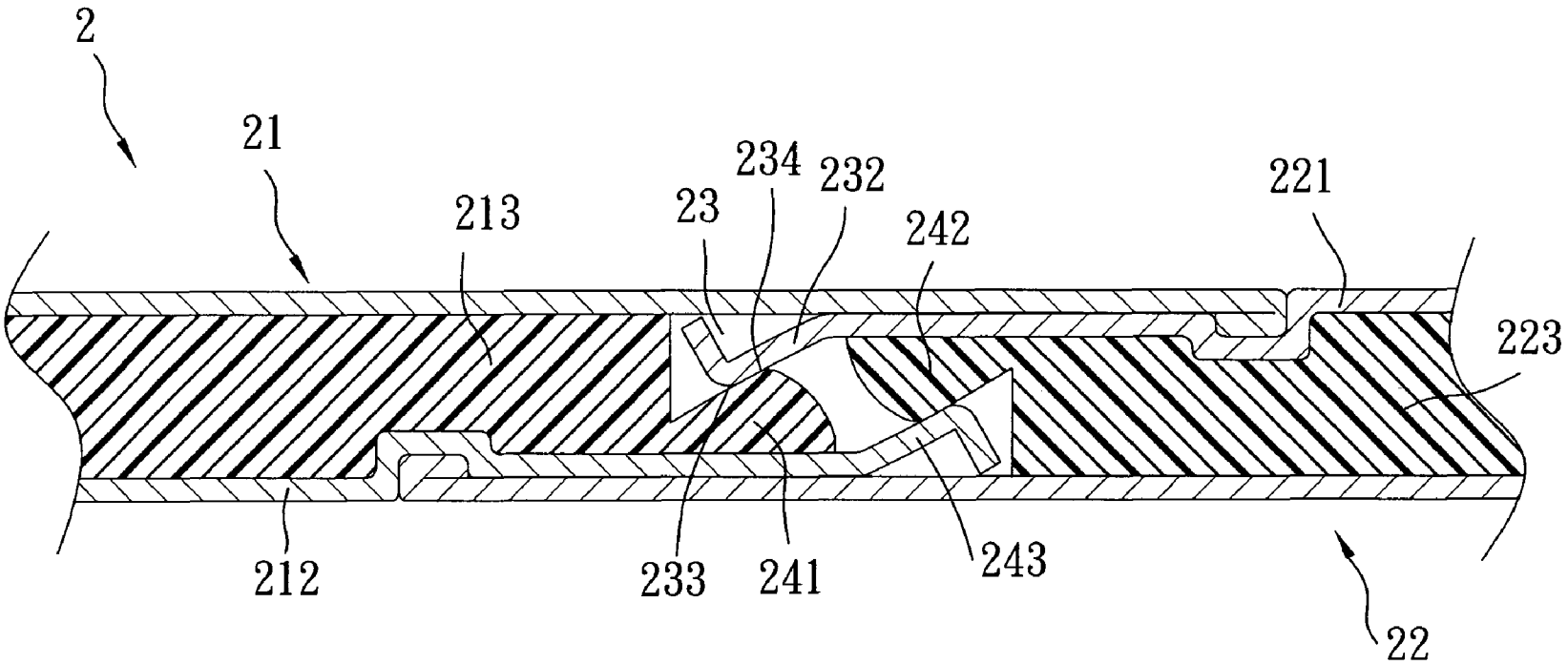
FIG. 4 is a fragmentary assembled sectional view of the second preferred embodiment of a composite panel assembly according to this invention.

As shown in FIG. 4, the second preferred embodiment of the composite panel assembly 2 according to the present invention has a structure similar to that of the first embodiment. The second preferred embodiment differs from the first embodiment in that, the first core 213 includes a protrusion 241 that extends toward the second core 223 and that defines the second contact surface 233. The bend segment 232 of the second composite panel 22 is releasably press-fitted against the protrusion 241 of the first composite panel 21.

In this embodiment, the second core 223 includes an auxiliary protrusion 242 that extends toward the first core 213, and the lower protective layer 212 of the first composite panel 21 includes a resilient auxiliary bend segment 243 that extends toward the second core 223. The auxiliary bend segment 243 of the first composite panel 21 is releasably press-fitted against the auxiliary protrusion 242 of the second composite panel 22.

Figure 5:
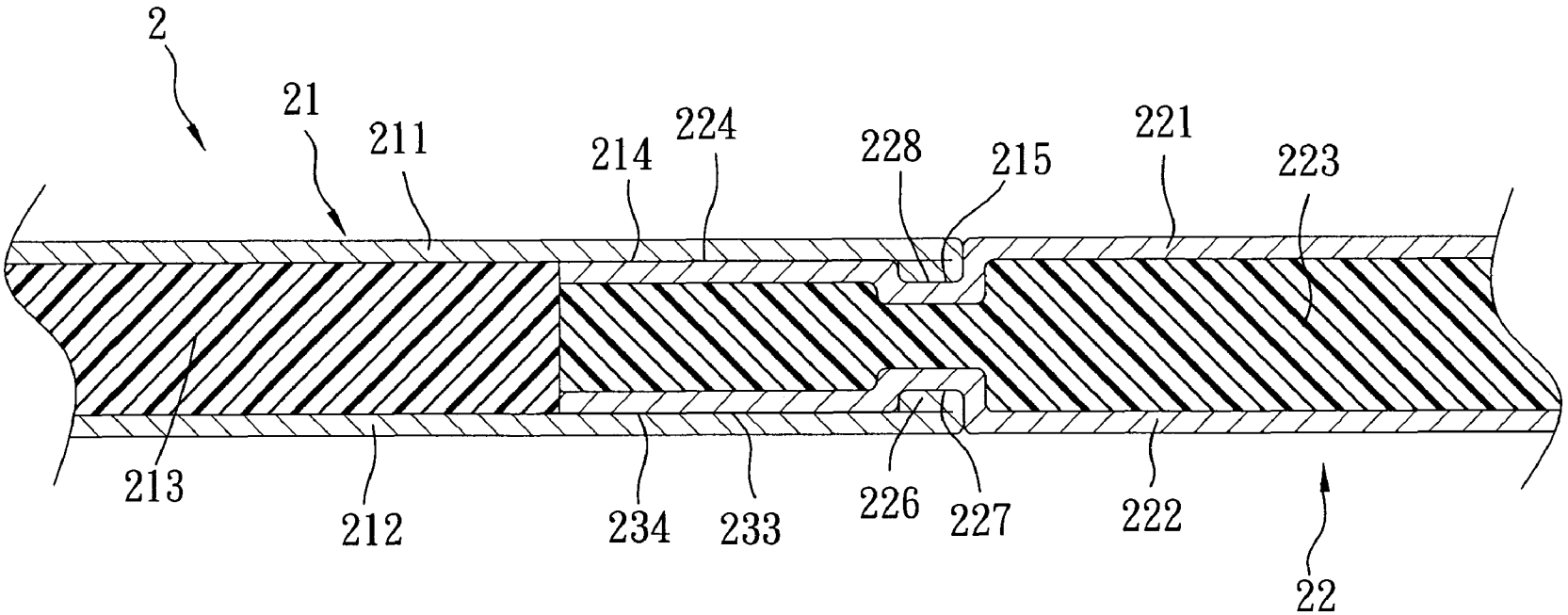
FIG. 5 is a fragmentary assembled sectional view of the third preferred embodiment of a composite panel assembly according to this invention.

FIG. 5 illustrates the third preferred embodiment of the composite panel assembly 2 according to the present invention. The third preferred embodiment differs from the first embodiment in that, the lower protective layer 222 of the second composite panel 22 defines the fourth contact surface 234, the recess 227 is formed in the lower protective layer 222 of the second composite panel 22, and the lower protective layer 212 of the first composite panel 22 has the insert 226.

In the third preferred embodiment, it is noted that the second core 223 is indented and narrowed at an end thereof so as to facilitate the formation of the recesses 227, 228, as well as insertion of part of the second composite panel 22 between ends of the upper and lower protective layers 211, 212 of the first composite panel 21.

In each of the preferred embodiments of the present invention described above, since the first contact surface 214 of the first composite panel 21 is disposed above and abuts against the third contact surface 224 of the second composite panel 22, and the second contact surface 233 of the first composite panel 21 is disposed below and abuts against the fourth contact surface 234 of the second composite panel 22, the aforesaid drawbacks associated with the prior art can be eliminated.

With the invention thus explained, it is apparent that various modifications and variations can be made without departing from the spirit of the present invention. It is therefore intended that the invention be limited only as recited in the appended claims.

What is claimed is:

1. A composite panel assembly comprising:

a first composite panel including upper and lower protective layers, each of which includes a core-abutment portion and an extending portion that extends from said core-abutment portion, and a first core sandwiched between said core-abutment portion of said upper protective layer and said core-abutment portion of said lower protective layer, said extending portion of said upper protective layer defining a first contact surface, said extending portion of said lower protective layer defining a second contact surface; and a second composite panel including upper and lower protective layers, each of which includes a core-abutment portion and an extending portion extending from said core-abutment portion of a corresponding one of said upper and lower protective layers of said second composite panel, and a second core sandwiched between said core-abutment portions of said upper and lower protective layers of said second composite panel, said core-abutment portion of said upper protective layer of said second composite panel defining a third contact surface, said extending portion of said upper protective layer of said second composite panel defining a fourth contact surface, wherein a space is defined between said first and second cores, said extending portion of said upper protective layer of said first composite panel extending beyond said space and overlapping said core-abutment portion of said upper protective layer of said second composite panel in such a manner that said first contact surface abuts against said third contact surface, said extending portion of said lower protective layer of said first composite panel and said extending portion of said upper protective layer of said second composite panel extending into said space in such a manner that said second contact surface abuts against said fourth contact surface; and wherein said core-abutment portion of said lower protective layer of said first composite panel defines a fifth contact surface, said extending portion of said lower protective layer of said second composite panel extending beyond said space and overlapping said core-abutment portion of said lower protective layer of said first composite panel and defining a sixth contact surface which abuts against said fifth contact surface.

2. The composite panel assembly of claim 1, wherein said third contact surface of said second composite panel is formed with a recess, said extending portion of said first composite panel that defines said first contact surface has a free end that is folded backward to form an insert, and said insert protrudes into said recess from said first contact surface.

3. A composite panel assembly comprising:

a first composite panel including upper and lower protective layers, each of which includes a core-abutment portion and an extending portion that extends from said core-abutment portion, and a first core sandwiched between said core-abutment portion of said upper protective layer and said core-abutment portion of said lower protective layer, said extending portion of said upper protective layer defining a first contact surface, said extending portion of said lower protective layer defining a second contact surface; and a second composite panel including upper and lower protective layers, each of which includes a core-abutment portion and an extending portion extending from said core-abutment portion of a corresponding one of said upper and lower protective layers of said second composite panel, and a second core sandwiched between said core-abutment portions of said upper and lower protective layers of said second composite panel, said core-abutment portion of said upper protective layer of said second composite panel defining a third contact surface, said extending portion of said upper protective layer of said second composite panel defining a fourth contact surface, wherein a space is defined between said first and second cores, said extending portion of said upper protective layer of said first composite panel extending beyond said space and overlapping said core-abutment portion of said upper protective layer of said second composite panel in such a manner that said first contact surface abuts against said third contact surface, said extending portion of said lower protective layer of said first composite panel and said extending portion of said upper protective layer of said second composite panel extending into said space in such a manner that said second contact surface abuts against said fourth contact surface; and wherein each of said core-abutment portions of said lower protective layer of said first composite panel and said upper protective layer of said second composite panel is formed with a recess, and each of said extending portions of said upper protective layer of said first composite panel and said lower protective layer of said second composite panel includes an insert, said insert of said extending portion of said upper protective layer of said first composite panel being fitted into said recess in said core-abutment portion of said upper protective layer of said second composite panel, and said insert of said extending portion of said lower protective layer of said second composite panel being fitted into said recess in said core-abutment portion of said lower protective layer of said first composite panel.

4. The composite panel assembly of claim 3, wherein said inserts are formed by folding respectively said extending portions of said upper protective layer of said first composite panel and said lower protective layer of said second composite panel.

5. A composite panel assembly comprising:

a first composite panel including upper and lower protective layers, each of which includes a core-abutment portion and an extending portion that extends from said core-abutment portion, and a first core sandwiched between said core-abutment portion of said upper protective layer and said core-abutment portion of said lower protective layer, said extending portion of said upper protective layer defining a first contact surface, said extending portion of said lower protective layer defining a second contact surface; and a second composite panel including upper and lower protective layers, each of which includes a core-abutment portion and an extending portion extending from said core-abutment portion of a corresponding one of said upper and lower protective layers of said second composite panel, and a second core sandwiched between said core-abutment portions of said upper and lower protective layers of said second composite panel, said core-abutment portion of said upper protective layer of said second composite panel defining a third contact surface, said extending portion of said upper protective layer of said second composite panel defining a fourth contact surface, wherein a space is defined between said first and second cores, said extending portion of said upper protective layer of said first composite panel extending beyond said space and overlapping said core-abutment portion of said upper protective layer of said second composite panel in such a manner that said first contact surface abuts against said third contact surface, said extending portion of said lower protective layer of said first composite panel and said extending portion of said upper protective layer of said second composite panel extending into said space in such a manner that said second contact surface abuts against said fourth contact surface;

wherein said extending portion of said lower protective layer of said first composite panel and said extending portion of said upper protective layer of said second composite panel respectively include bend segments that define respectively said second contact surface and said fourth contact surface, said bend segments of said first and second composite panels being releasably press-fitted against each other in the space; and wherein said bend segments are substantially V-shaped, and each have a vertex and a free end, said bend segments bending toward each other near said vertex to make contact between said second and fourth contact surfaces and bending away from each other at said free ends.

* * * * *